US008779686B2

(12) United States Patent
Jin

(10) Patent No.: US 8,779,686 B2
(45) Date of Patent: Jul. 15, 2014

(54) SYNCHRONOUS REGULATION FOR LED STRING DRIVER

(75) Inventor: Xiaoping Jin, Orange, CA (US)

(73) Assignee: Microsemi Corporation, Aliso Viejo, CA (US)

( * ) Notice: Subject to any disclaimer, the term of this patent is extended or adjusted under 35 U.S.C. 154(b) by 253 days.

(21) Appl. No.: 13/279,445

(22) Filed: Oct. 24, 2011

(65) Prior Publication Data

US 2012/0098442 A1 Apr. 26, 2012

Related U.S. Application Data

(60) Provisional application No. 61/406,136, filed on Oct. 24, 2010.

(51) Int. Cl.
*H05B 39/04* (2006.01)
*H05B 33/08* (2006.01)

(52) U.S. Cl.
CPC ..... *H05B 33/0815* (2013.01); *H05B 33/0827* (2013.01)
USPC ..... 315/294

(58) Field of Classification Search
USPC ..... 315/291, 294, 307, 312, 200 R, 185 R, 315/209 R, 224, 246, 274, 275, 276
See application file for complete search history.

(56) References Cited

U.S. PATENT DOCUMENTS 4,562,338 A 12/1985 Okami
7,411,358 B2 8/2008 Shimura et al.
7,923,943 B2 4/2011 Peker et al.
2003/0001524 A1 1/2003 Lin et al.
2004/0251854 A1 12/2004 Matsuda et al.
2005/0093471 A1 5/2005 Jin
2005/0093472 A1 5/2005 Jin
2005/0179393 A1 8/2005 Marakami et al.
2005/0225261 A1 10/2005 Jin
2007/0013321 A1* 1/2007 Ito et al. ..... 315/247
2008/0116818 A1 5/2008 Shteynberg et al.
2008/0272743 A1 11/2008 Ackermann et al.
2009/0009088 A1* 1/2009 Ito et al. ..... 315/77

(Continued)

FOREIGN PATENT DOCUMENTS

EP 0587923 3/1994
WO 96/38024 11/1996

OTHER PUBLICATIONS

International Search Report for parallel PCT case: PCT/US2011/057431 issued Mar. 14, 2012 European Patent Office.

(Continued)

*Primary Examiner* — Minh D A
(74) *Attorney, Agent, or Firm* — Simon Kahn

(57) ABSTRACT

A light emitting diode (LED) based luminaire driving arrangement constituted of: a switched driver; a plurality of LED based luminaries arranged to receive power from the switched driver; at least one electronically controlled switch in series with at least one of the plurality of LED based luminaries and arranged to alternatively pass current through the at least one LED based luminaire when closed and prevent the flow of current through the at least one LED based luminaire when opened; and at least one synchronous driver in communication with the at least one electronically controlled switch, the at least one synchronous driver arranged to close the at least one electronically controlled switch only when the switched driver is actively supplying power.

9 Claims, 10 Drawing Sheets

(56) References Cited

U.S. PATENT DOCUMENTS

| | | | | |
|---|---|---|---|---|
| 2009/0195174 | A1 | 8/2009 | Jin | |
| 2009/0195175 | A1 | 8/2009 | Jin | |
| 2009/0195178 | A1 | 8/2009 | Jin | |
| 2009/0295776 | A1* | 12/2009 | Yu et al. | 345/212 |
| 2010/0019692 | A1* | 1/2010 | Kimura | 315/294 |
| 2010/0019696 | A1* | 1/2010 | Kimura | 315/297 |
| 2010/0052568 | A1 | 3/2010 | Cohen | |
| 2010/0090607 | A1 | 4/2010 | Vos | |
| 2010/0164403 | A1* | 7/2010 | Liu | 315/297 |
| 2010/0237786 | A1* | 9/2010 | Santo et al. | 315/185 R |
| 2010/0237802 | A1 | 9/2010 | Aso | |
| 2010/0253302 | A1 | 10/2010 | Otte et al. | |
| 2010/0283322 | A1 | 11/2010 | Wibben | |
| 2011/0062889 | A1 | 3/2011 | Hoogzaad et al. | |
| 2011/0068700 | A1 | 3/2011 | Fan | |
| 2012/0013259 | A1 | 1/2012 | Jin | |

OTHER PUBLICATIONS

Written Opinion of the International Searching Authority for parallel PCT case: PCT/US2011/057431 issued Mar. 14, 2012 European Patent Office.

Williams, B.W.; "Power Electronics Devices, Drivers, Applications and Passive Components"; Second Edition, McGraw-Hill, 1992; Chapter 10, pp. 218-249.

Bradley, D.A., "Power Electronics" 2nd Edition; Chapman & Hall, 1995; Chapter 1, pp. 1-38.

Dubey, G. K., "Thyristorised Power Controllers"; Halsted Press, 1986; pp. 74-77.

First Office Action dated Jan. 15, 2014 from the Intellectual Property Office of Taiwan for parallel application TW 100139048.

* cited by examiner

SYNCHRONOUS REGULATION FOR LED STRING DRIVER

CROSS-REFERENCE TO RELATED APPLICATION

This application claims priority from U.S. Provisional Patent Application Ser. No. 61/406,136 filed Oct. 24, 2010, entitled "Synchronous Regulation for LED String Driver", the entire contents of which is incorporated herein by reference.

BACKGROUND OF THE INVENTION

The present invention relates to the field of solid state lighting, and in particular to an arrangement of one or more LED strings switched synchronously with input switches of a single stage power supply.

Light emitting diodes (LEDs) and in particular high intensity and medium intensity LED strings are rapidly coming into wide use for lighting applications. LEDs with an overall high luminance are useful in a number of applications including backlighting for liquid crystal display (LCD) based monitors and televisions, collectively hereinafter referred to as a matrix display, as well as for general lighting applications.

In a large LCD matrix display, and in large solid state lighting applications, such as street lighting and signage, typically the LEDs are supplied in a plurality of strings of serially connected LEDs, at least in part so that in the event of failure of one string at least some light is still output. The constituent LEDs of each LED string thus share a common current.

LEDs providing high luminance exhibit a range of forward voltage drops, denoted $V_f$, and their luminance is primarily a function of current. For example, one manufacturer of LEDs suitable for use with a portable computer, such as a notebook computer, indicates that $V_f$ for a particular high luminance white LED ranges from 2.95 volts to 3.65 volts at 20 mA and an LED junction temperature of 25° C., thus exhibiting a variance in $V_f$ of greater than ±10%. Furthermore, the luminance of the LEDs vary as a function of junction temperature and age, typically exhibiting a reduced luminance as a function of current with increasing temperature and increasing age. In order to provide backlight illumination for a portable computer with an LCD matrix display of at least 25 cm measured diagonally, at least 20, and typically in excess of 40, LEDs are required. In order to provide street lighting, in certain applications over 100 LEDs are required.

In order to provide a balanced overall luminance, it is important to control the current of the various LED strings to be approximately equal. In one embodiment a power source is supplied for each LED string, and the voltage of the power source is controlled in a closed loop to ensure that the voltage output of the power source is consonant with the voltage drop of the LED string, however the requirement for a power source for each LED string is quite costly.

In another embodiment, as described in U.S. Patent Application Publication US 2007/0195025 to Korcharz et al, entitled "Voltage Controlled Backlight Driver" and published Aug. 23, 2007, the entire contents of which is incorporated herein by reference, this is accomplished by a controlled dissipative element placed in series with each of the LED strings. In another embodiment, binning is required, in which LEDs are sorted, or binned, based on their electrical and optical characteristics. Thus, in order to operate a plurality of LED strings from a single power source, at a common current, either binning of the LEDs to be within a predetermined range of $V_f$ is required, or a balancing element, such as the dissipative element of the aforementioned patent application, must be supplied to drop the voltage difference between the strings caused by the differing $V_f$ values so as to produce an equal current through each of the LED strings. Either of these solutions adds to cost and/or wasted energy.

U.S. Pat. No. 7,242,147 issued Jul. 10, 2007 to Jin, entitled "Current Sharing Scheme for Multiple CCF Lamp Operation", the entire contents of which is incorporated herein by reference, is addressed to a balancer, wherein each CCFL is connected to an AC power source lead via a primary transformer winding. The secondary windings are connected in a closed in-phase loop. The balancer requires an alternating current input in order to avoid DC saturation of the transformers, and is thus not suitable for use with LED strings, which operate only on DC.

LED strings present a significantly different load than incandescent lighting, and in particular the current does not vary in step with the input voltage. The power factor of an alternating current (AC) electric power system is defined as the ratio of real power to the apparent power flowing to a load. Real power is the capacity of the circuit to perform work in a particular time, whereas apparent power is a product of the current and voltage of the circuit. Power is lost in the system when the power factor is significantly below unity. A power factor corrector (PFC) may be advantageously utilized to control the power source providing electrical energy to the LED string so as to achieve a power factor approaching unity. A power factor corrector typically comprises an error amplifier and a multiplier arranged to cooperate so as to maintain a high power factor while controlling a power converter so as to converge the input to the error amplifier towards a reference value.

LED strings exhibit a particular voltage to current relationship, wherein for a voltage below a minimum operating voltage no appreciable current flows, and for voltages exceeding the minimum operating voltage the current follows an exponential curve responsive to the voltage. Small changes in voltage thus result in very large changes in current, which may result in extremely large power surges before correction by the slow response time of the PFC control loop.

A two stage power source and driver provides a first stage with PFC and a second stage which advantageously exhibits a fast control loop, capable of preventing such large power surges. Unfortunately, a two stage power source and driver adds expense and may further exhibit a reduced efficiency as compared with a single stage power source and driver. Additionally, in many prior art applications three stages are in effect provided: the PFC stage, the voltage converter stage and the dissipative balancer stage, which all add to cost and losses.

SUMMARY OF THE INVENTION

Accordingly, it is a principal object of the present invention to overcome at least some of the disadvantages of the prior art. This is provided in certain embodiments by an arrangement comprising at least one LED string connected in series with an electronically controlled switch, the at least one LED string receiving power from a power transformer secondary winding, the primary winding of the transformer arranged to receive power from a switching bridge. Preferably the switching bridge receives power from a PFC stage connected to an AC mains network in cooperation with a full wave rectifier. The electronically controlled switch connected in series with the LED string is controlled synchronously with the switching waveform of the switching bridge. Preferably a capacitor is further provided in parallel with each LED string so as to prevent large current swings responsive to the switching of the switching bridge. Optionally the capacitor is switchably connected so as to eliminate any tail current after shut off of the electronically controlled switch.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
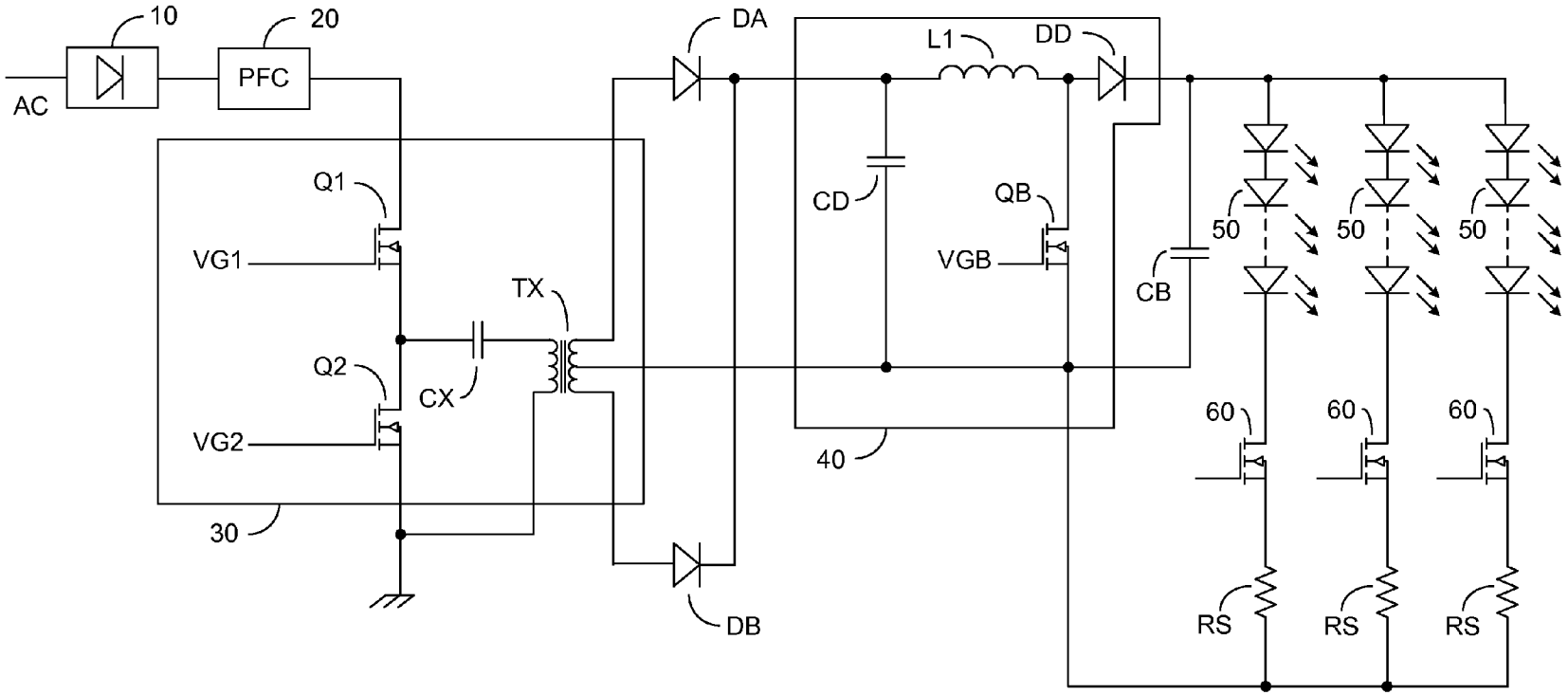
FIG. 1 PRIOR ART
FIG. 1 illustrates a high level schematic diagram of a driving architecture of the prior art comprising a PFC stage, a switching bridge, a boost converter and a controllable dissipative element in series with each of a plurality of parallel connected LED strings.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting. The term winding is particularly meant to mean a winding of electrically conducting wire forming an inductor. The winding may form a stand alone inductor, or be magnetically coupled to another winding forming a transformer. Certain embodiments are described herein in relation to LED strings, however this is not meant to be limiting but is rather a particular example of an LED based luminaire. A single high powered LED or other LED based luminaire may be utilized in place of an LED string without exceeding the scope.

FIG. 1 illustrates a high level schematic diagram of a driving architecture of the prior art comprising: an AC mains power; a full wave rectifier 10; a PFC stage 20; an isolated switching bridge stage 30 with a pair of unidirectional electronic valves DA and DB; a boost converter 40; a filtering capacitor CB; and a plurality of LED strings 50 each associated with a controllable dissipative element 60 and a respective sense resistor RS. Isolated switching bridge stage 30 comprises a pair of electronically controlled switches denoted Q1 and Q2, illustrated without limitation as NMOSFETs, a blocking capacitor CX, and a power transformer TX. Boost converter 40 comprises an input capacitor CD, an inductor L1, an electronically controlled switch QB and a unidirectional electronic valve DD.

The AC mains power is connected to full wave rectifier 10, and the output of full wave rectifier 10 is connected to the input of isolated switching bridge stage 30 via PFC stage 20. Isolated switching bridge stage 30 is connected between the output of PFC stage 20 and a common point, in one embodiment the common point being ground. Electronically controlled switch Q1 is controlled by a gate voltage VG1 and electronically controlled switch Q2 is controlled by a gate voltage VG2. In particular, the drain of electronically controlled switch Q1 is connected to the output of PFC stage 20 and the source of electronically controlled switch Q1 is connected to the drain of electronically controlled switch Q2 and to a first end of blocking capacitor CX. The second end of blocking capacitor CX is connected to a first end of a primary winding of power transformer TX and a second end of the primary winding of power transformer TX is connected to the source of electronically controlled switch Q2 and to the common point.

A first end of a secondary winding of power transformer TX is connected via unidirectional electronic valve DA to a first end of input capacitor CD and a first end of inductor L1. A second end of the secondary winding of power transformer TX is connected via unidirectional electronic valve DB to the first end of input capacitor CD and the first end of inductor L1. A second end of inductor L1 is connected to the anode of unidirectional electronic valve DD and to the drain of electronically controlled switch QB. The cathode of unidirectional electronic valve DD is connected to a first end of filtering capacitor CB and to the anode end of each LED string 50. The gate of electronically controlled switch QB is controlled by a gate voltage VGB, and the source of electronically controlled switch QB is connected to a center tap connection of the secondary winding of power transformer TX, to a second end of input capacitor CD and to a second end of filtering capacitor CB. The cathode end of each LED string 50 is connected to the drain of the respective controllable dissipative element 60 and the source of each controllable dissipative element 60 is connected via a respective sense resistor RS to the center tap connection of the secondary winding of power transformer TX.

In operation, the received AC mains power is converted to a DC bus, in one embodiment a DC bus of 400V, by PFC stage 20, and the PFC voltage is converted by isolated switching bridge stage 30, illustrated without limitation as a half bridge driving the primary winding of power transformer TX. The output from the secondary winding of power transformer TX is rectified by unidirectional electronic valves DA and DB and fed to boost converter 40. LED strings 50 are powered from the output of boost converter 40 and controlled by the respective controllable dissipative elements 60 acting as linear regulators. In particular, currents through the LED strings are controlled to be equal by linear regulation of controllable dissipative elements 60 which adjust the voltage drop across each of the controllable dissipative elements 60. Boost converter 40 remains operative at all times, and the output voltage of boost converter 40 is controlled to be at a minimum level for which current regulation of the LED string 50 with the highest voltage drop can be maintained.

Power dissipation and associated heat generation is high, which is particularly problematic in the event that controllable dissipative elements 60 are provided on-board an integrated circuit. The power train from the PFC stage to LED strings 50 comprises three stages—isolated switching bridge stage 30, boost converter 40, and the linear current regulation stage of the respective controllable dissipative elements 60, with associated power losses and cost of the components.

Figure 2A:
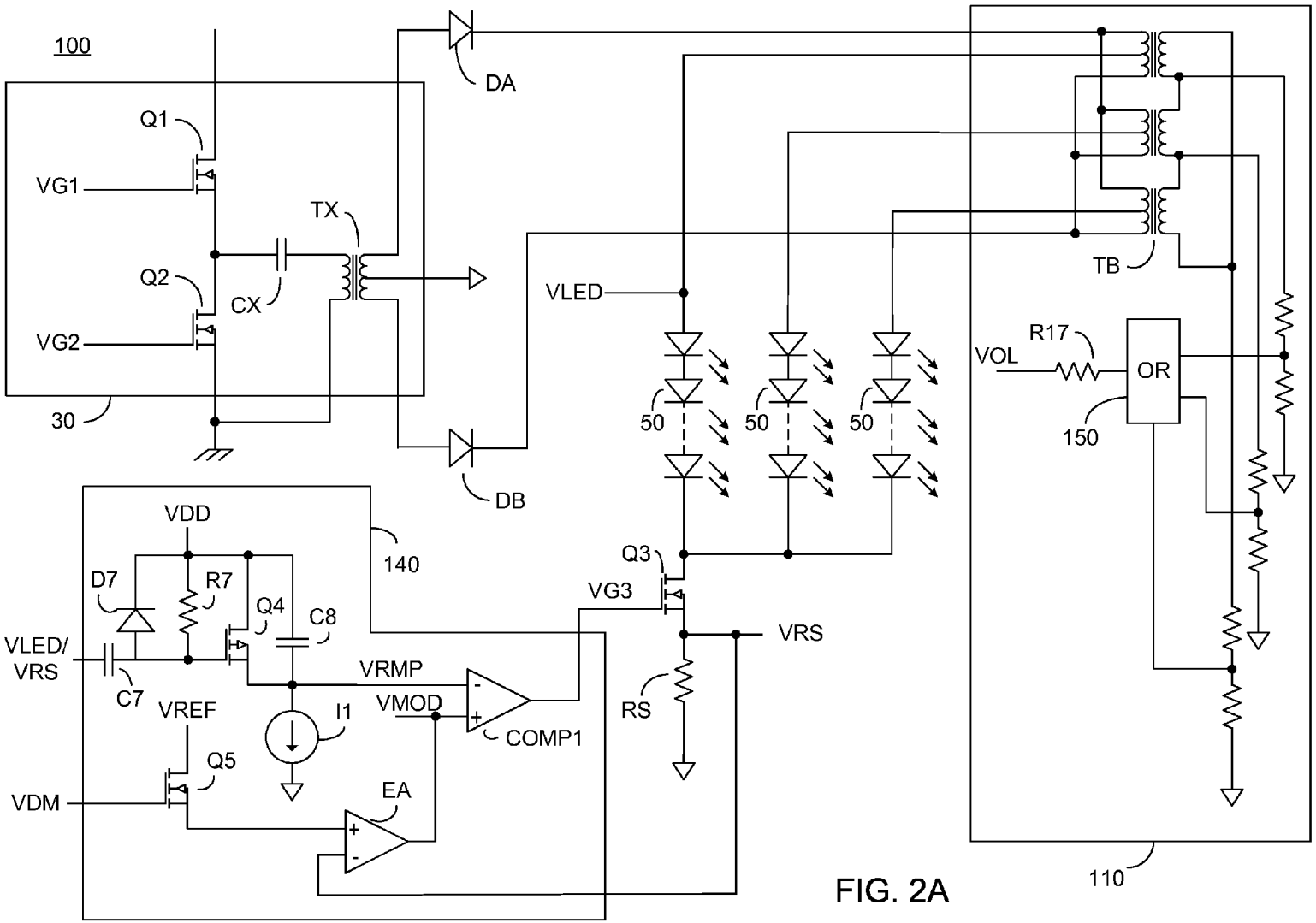
FIG. 2A illustrates a high level schematic diagram of an exemplary embodiment of a synchronous driving architecture for a plurality of LED strings, comprising a balancer.

FIG. 2A illustrates a high level schematic diagram of an exemplary embodiment of a synchronous driving architecture 100 comprising: a plurality of LED strings 50, an isolated switching bridge stage 30, a balancer 110, a pair of unidirectional electronic valves DA and DB, an electronically controlled switch Q3, illustrated without limitation as an NMOSFET, and a synchronous driver 140. Isolated switching bridge stage 30 is in all respects similar to isolated switching bridge stage 30 of FIG. 1, and a full wave rectifier 10 and PFC stage 20 are preferably further supplied (not shown) as described above in relation to FIG. 1. Balancer 110 comprises a plurality of balancing transformers TB each constituted of a first winding and a second winding magnetically coupled to the first winding, each associated with a particular resistor divider network and a diode ORING circuit 150.

A first end of the secondary winding of power transformer TX is connected via unidirectional electronic valve DA to a first end of a primary winding of each balancing transformer TB and a second end of the secondary winding of power transformer TX is connected via unidirectional electronic valve DB to a second end of a primary winding each balancing transformer TB. The center tap of the primary winding of each balancing transformer TB is connected to the anode end of an associated LED string 50, and the cathode end of each of the LED strings 50 is connected to the drain of electronically controlled switch Q3. The source of electronically controlled switch Q3 is connected via a sense resistor RS to a common potential. The source of electronically controlled switch Q3, denoted VRS, or alternatively the anode end of one of the LED strings 50, denoted VLED is connected to the input of synchronous driver 140. In the event that VLED is connected to the input of synchronous driver 140 it is preferably scaled appropriately prior to input into synchronous driver 140. Alternatively, other signals having a rising or a falling edge synchronous with the switching action of electronically controlled switches Q1 and Q2, or synchronous with the rectified voltage VLED, can be utilized as the input of synchronous driver 140 to realize synchronous switching operation of electronically controlled switch Q3.

The input of synchronous driver 140 is fed to the gate of an electronically controlled switch Q4, illustrated without limitation as a PMOSFET, via a capacitor C7. The drain of electronically controlled switch Q4 is connected to a voltage potential VDD, to a first end of a capacitor C8, a first end of a resistor R7 and to the cathode of a unidirectional electronic valve D7. The gate of electronically controlled switch Q4 is further connected to the anode of unidirectional electronic valve D7 and the second end of resistor R7. The source of electronically controlled switch Q4 is connected to a first end of a current source I1, to the inverting input of a comparator COMP1 and to the second end of capacitor C8. The second end of current source I1 is connected to the common potential. A digital dimming signal VDM is connected to the gate of an electronically controlled switch Q5, illustrated without limitation as an NMOSFET, and the drain of electronically controlled switch Q5 is connected to a reference potential denoted VREF. The source of electronically controlled switch Q5 is connected to the non-inverting input of a differential amplifier EA and the output of differential amplifier EA is connected as a signal VMOD to the non-inverting input of comparator COMP1. The inverting input of differential amplifier EA is connected to signal VRS, and the output of comparator COMP1 is connected to the gate of electronically controlled switch Q3 and denoted VG3.

The secondary windings of the various balancing transformers TB are connected in a closed in phase serial loop, with the voltages of common nodes between balancing transformers sampled by a respective resistor divider network and ORed via the diode ORING circuit 150 to an output VOL via a resistor R17.

Figure 2B:
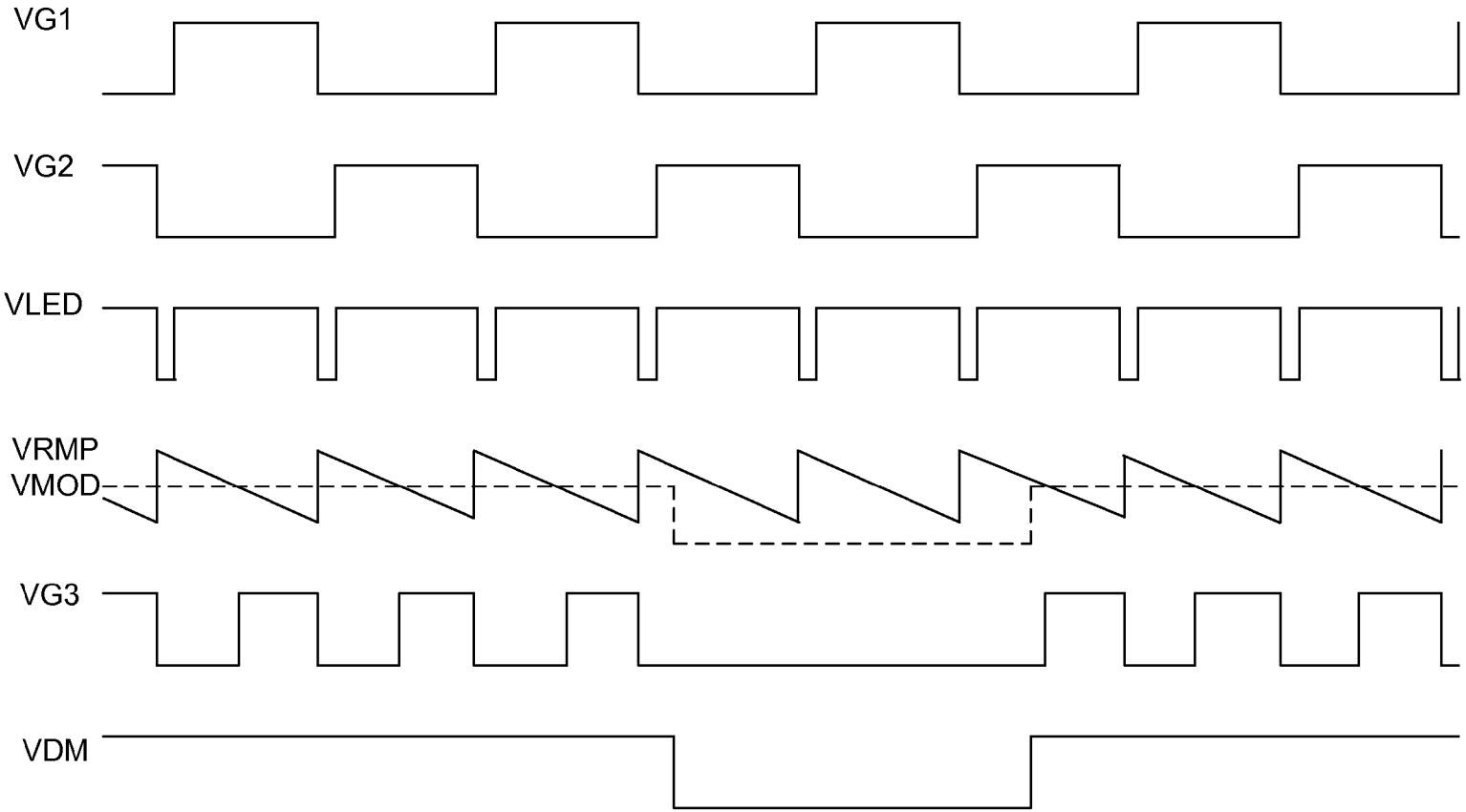
FIG. 2B illustrates certain signals of the synchronous driving architecture of FIG. 2A.

In operation, and in reference to the voltage waveforms of FIG. 2B wherein the y-axis represents voltage and the x-axis represents time in a common axis, the various LED strings 50 are powered from the secondary winding of power transformer TX through unidirectional electronic valves DA and DB and current through the various LED strings 50 is balanced by the action of balancer 110. Thus, operation of the various LED strings 50 is provided directly from the output of power transformer TX without requiring boost converter 40 of FIG. 1 and without requiring linear regulation of each LED string 50.

Electronically controlled switch Q3 is controlled by signal VG3 synchronously with signal VG1 and VG2, thus ensuring that current is drawn through electronically controlled switch Q3 only when power is being supplied by either Q1 or Q2. In particular, and in reference to an embodiment in which a scaled version of VLED is supplied as an input to synchronous driver 140 at capacitor C7, in operation electronically controlled switch Q3 switches responsive to synchronous driver 140 synchronously with the voltage applied to the anode of the LED string 50 having VLED connected thereto, the frequency being twice the switching frequency of electronically controlled switches Q1, Q2. Control of the average current through the various LED strings 50 is achieved by adjusting the duty cycle of electronically controlled switch Q3, i.e. pulse width modulation (PWM). Electronically controlled switch Q3 controls the current through all of the LED strings 50, and the total current is evenly distributed over the various LED strings 50 by the action of balancer 110, which is described in the above incorporated U.S. Pat. No. 7,242,147.

The PWM modulation of electronically controlled switch Q3 is in one embodiment trailing edge modulation, wherein the leading edge of signal VG3 driving electronically controlled switch Q3 is synchronous with the switching on respectively of electronically controlled switches Q1, Q2, and the trailing edge of signal VG3 is modulated to adjust the pulse width. In another embodiment leading edge modulation is employed, wherein the trailing edge of signal VG3 driving electronically controlled switch Q3 is synchronous with the switching off respectively of electronically controlled switches Q1, Q2, and the leading edge of signal VG3 is modulated to adjust the pulse width. Leading edge modulation is illustrated herein without limitation, advantageously minimizing the switching off transient for electronically controlled switch Q3. When electronically controlled switch Q4 is off, current source I1 of synchronous driver 140 charges capacitor C8 to generate ramp down slope signal VRMP, and electronically controlled switch Q3 is on whenever single VMOD>signal VRMP. At the falling edge of VLED or VRS, either of which is preferably first scaled to the right amplitude, electronically controlled switch Q4 is turned on discharging capacitor C8 and pulling signal VRMP to VDD thus turning off electronically controlled switch Q3 via signal VG3. PWM control signal VG3 is thus switched off at the falling edge of signal VLED (OR VRS) synchronously. The presence of unidirectional electronic valve D7 provides a discharge path for capacitor C7 at the rising edge of signal VLED to reset its voltage for repeated operation. Signal VMOD is supplied from differential amplifier EA acting as a current control error amplifier, and its output is compared with the saw tooth waveform of VRMP to be used for PWM comparator COMP1 so as to modulate the PWM output signal VG3. As the value of signal VMOD increases the duty cycle of electronically controlled switch Q3 increases, and as the value of signal VMOD decreases the duty cycle of electronically controlled switch Q3 decreases.

As indicated above, signal VRS may be similarly used as a synchronization control. The advantage of using VRS is that electronically controlled switch Q3 is switched off at zero current, eliminating switching off transients.

As illustrated in FIGS. 2A and 2B, switching control of electronically controlled switch Q3 is optionally further utilized for digital dimming control. Signal VDM represents a digital dimming control signal, preferably exhibiting a low frequency of about 100 to 1000 Hz. When signal VDM is at a high state, reference potential VREF appears at the non-inverting input of differential amplifier EA, wherein reference potential VREF represents the target current through electronically controlled switch Q3. Signal VDM thus modulates the duty cycle of electronically controlled switch Q3 responsive to the difference between signal VRS and reference potential VREF. When signal VDM is at a low state, electronically controlled switch Q5 is turned off, and the non-inverting input of differential amplifier EA falls towards the common potential, thus pulling VMOD negative and shutting off electronically controlled switch Q3. Preferably a pull down resistor is supplied for the non-inverting input of differential amplifier EA to ensure proper operation (not shown). Thus a single synchronous driver 140 for electronically controlled switch Q3 performs both LED current regulation and digital dimming control functions with low loss.

In the event that any of LED strings 50 exhibits an open circuit failure, the voltage in the secondary winding of the respective balancing transformer TB rises dramatically, and such voltage rise is used to detect an open LED condition. The signals from the nodes of the secondary loop are preferably logically OR'D by diodes, as illustrated, and the detection signal VOL is fed to a controller or control circuit as an open LED fault signal.

Figure 3:
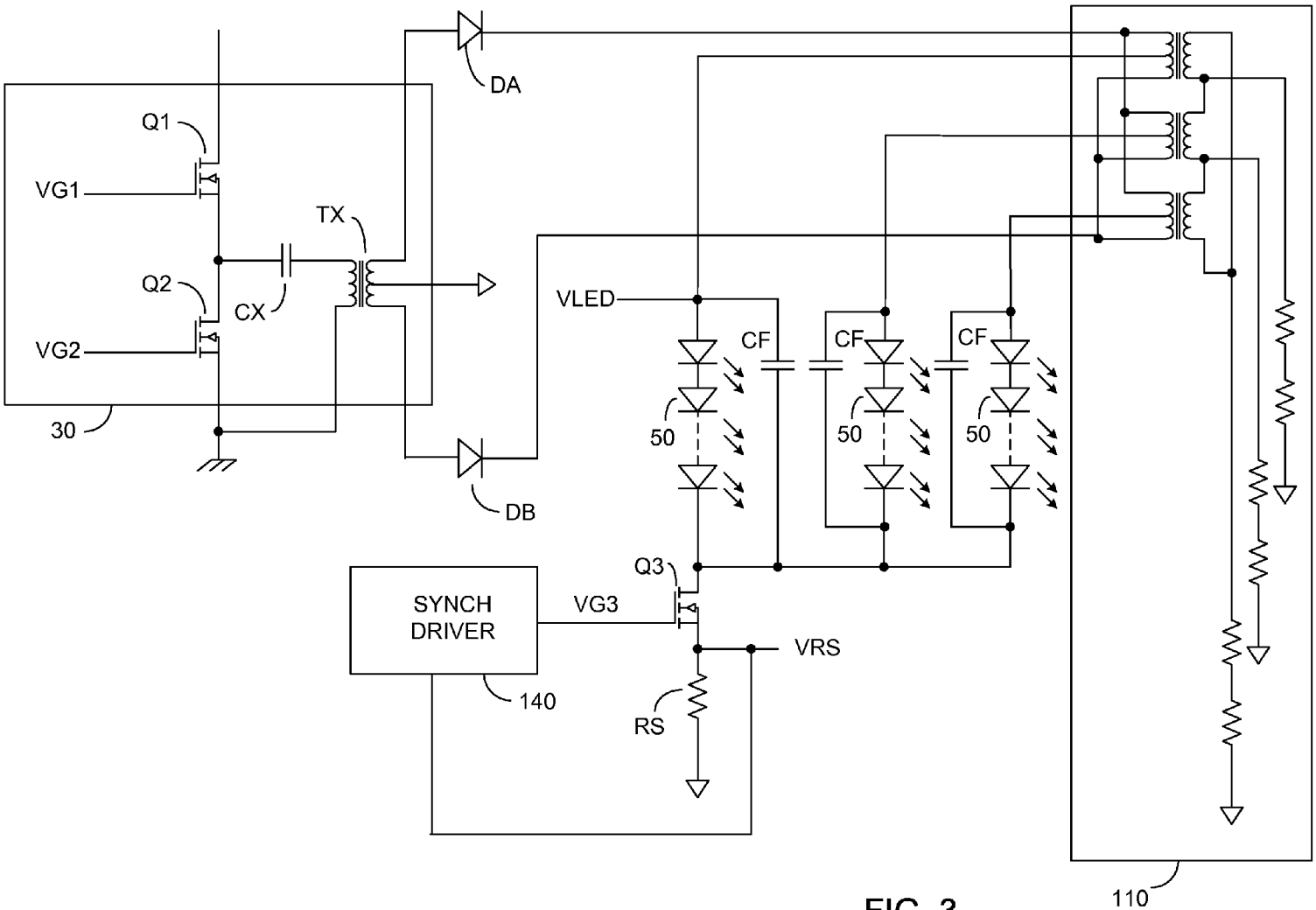
FIG. 3 illustrates a high level schematic diagram of an exemplary embodiment of a synchronous driving architecture for a plurality of LED strings, comprising a capacitor in parallel with each LED string and further comprising a balancer.

FIG. 3 illustrates a high level schematic diagram of an exemplary embodiment of a synchronous driving architecture for a plurality of LED strings, comprising a filtering capacitor CF in parallel with each LED string 50 and further comprising balancer 110. The architecture of FIG. 3 is in all respects identical with that of FIG. 2, with the exception that filtering capacitor CF is supplied in parallel with each LED string 50. Filtering capacitor CF reduces any ripple current, since the voltage across each LED string 50 is prevented from rapidly changing by the action of filtering capacitor CF.

Unfortunately, filtering capacitor CF may produce a tail current through the various LED strings 50 after signal VDM goes to a low state, due to the residual voltage on the capacitor when electronically controlled switch Q3 is shut off. In some applications, particularly backlight applications for monitor and televisions, LED current is preferably totally off during digital dimming off period.

Figure 4:
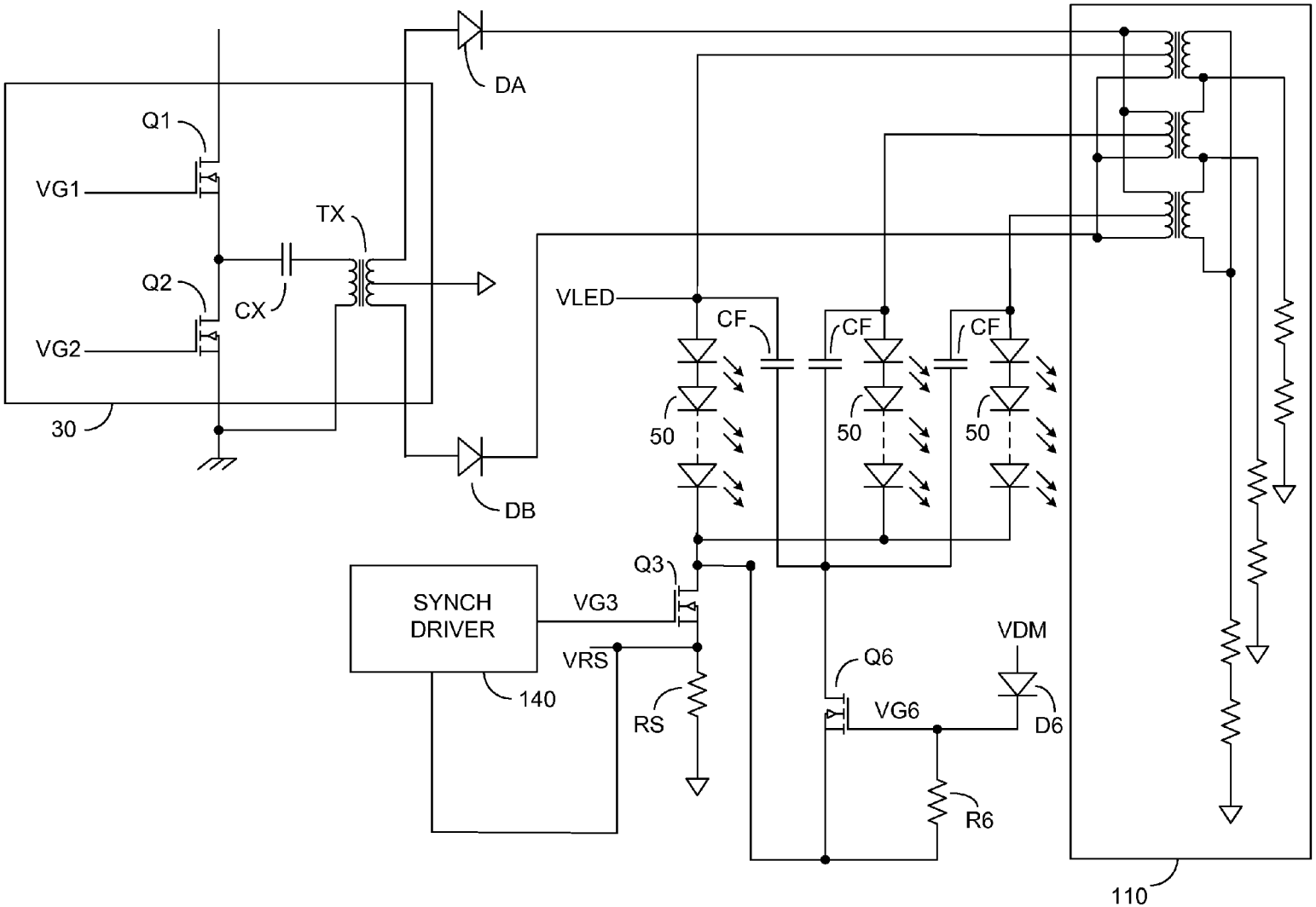
FIG. 4 illustrates a high level schematic diagram of an exemplary embodiment of a synchronous driving architecture for a plurality of LED strings, comprising a switched capacitor in parallel with each LED string and further comprising a balancer.

FIG. 4 illustrates a high level schematic diagram of an exemplary embodiment of a synchronous driving architecture for a plurality of LED strings, comprising a switched filtering capacitor CF in parallel with each LED string 50 and further comprising balancer 110, thus resolving the aforementioned tail current. The architecture of FIG. 4 is in all respects identical with that of FIG. 3, with the exception that filtering capacitors CF are switched in parallel with each LED string 50 by the action of electronically controlled switch Q6, illustrated without limitation as an NMOSFET. In further detail, a first end of each filtering capacitor CF is connected to the anode end of a respective LED string 50 and a second end of each of the filtering capacitors CF is connected to the drain of electronically controlled switch Q6. Voltage VDD is connected via a unidirectional electronic valve D6 to the gate of electronically controlled switch Q6 and to a first end of a resistor R6, and a second end of resistor R6 is connected to the source of electronically controlled switch Q6 and to the drain of electronically controlled switch Q3.

In operation, electronically controlled switch Q6 is turned on when digital dimming signal VDM is on, i.e. in a high state, and turned off when the digital dimming VDM is off, i.e. in a low state. Gate control of electronically controlled switch Q6 can be realized by a drive circuit (not shown) in association with digital dimming signal VDM. In greater detail, when Q3 is turned on responsive to VDM being in an on state and VRMP being less than VMOD, the gate capacitance (C6) of electronically controlled switch Q6 is charged up to VDD via unidirectional electronic valve D6. The switching of electronically controlled switch Q3 is at a relatively high frequency, typically>200 KHz, and the time constant of R6*C6 is set to be larger than the switching period of electronically controlled switch Q3, preferably more than 5 times larger, thus electronically controlled switch Q6 stays on during the off of electronically controlled switch Q3. During the digital dimming off period, i.e. when digital dimming signal VDM is off, i.e. in a low state, electronically controlled switch Q3 is turned off for a significantly longer period than the time constant of R6*C6, and the gate capacitance of electronically controlled switch Q6 discharges through R6 thus shutting off electronically controlled switch Q6 when digital dimming is off. In one non-limiting example, wherein the switching frequency of electronically controlled switch Q3 is 200 KHz and the digital dimming frequency of signal VDM is 200 Hz, with an R6*C6 time constant of about 30 us, electronically controlled switch Q6 remains on throughout each period of electronically controlled switch Q3, and goes off after about six switching cycles for electronically controlled switch Q3 after digital dimming signal VDM turns off, which is about 0.6% digital dimming duty.

Figure 5:
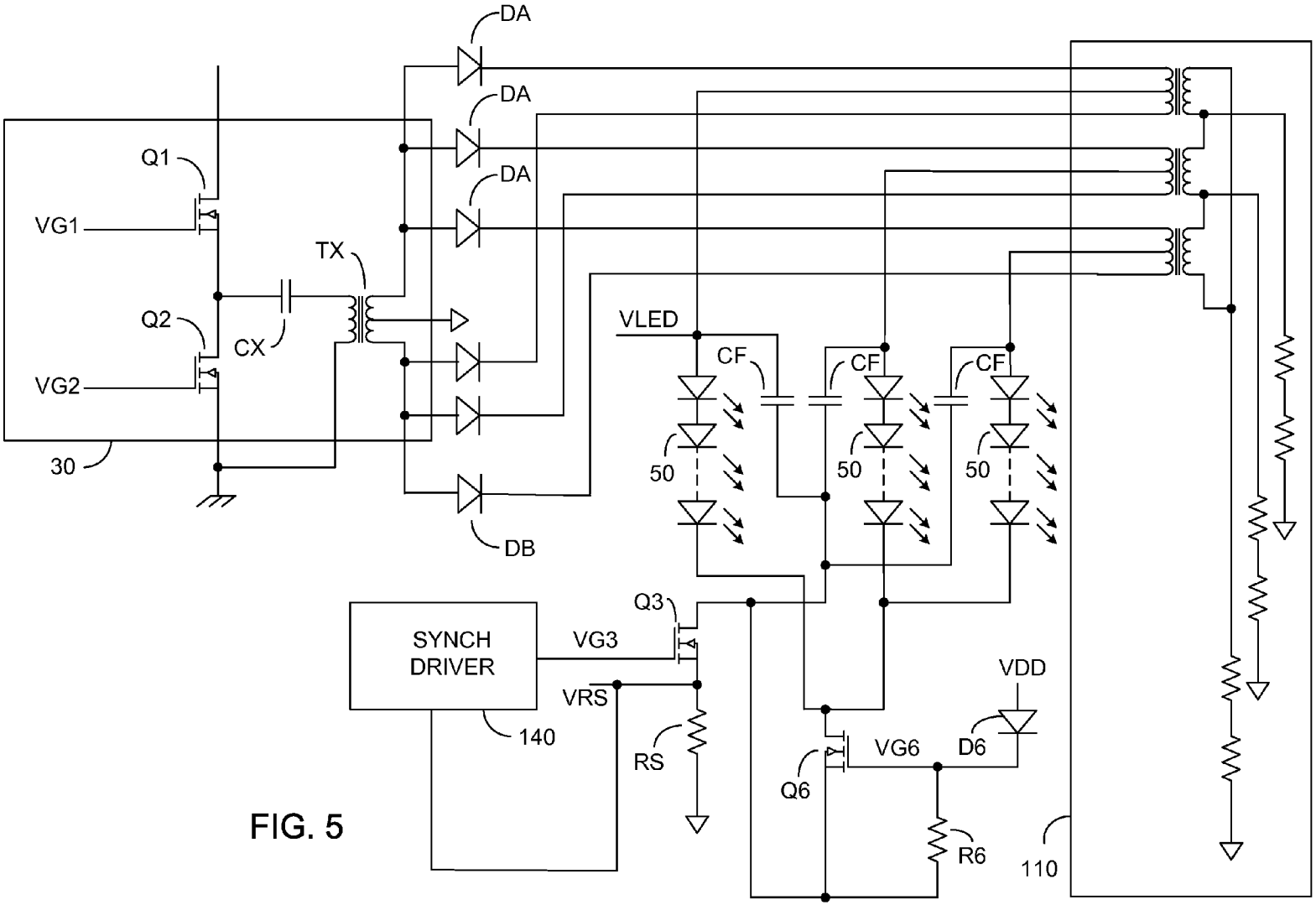
FIG. 5 illustrates a high level schematic diagram of an exemplary embodiment of a synchronous driving architecture for a plurality of LED strings, comprising a separate rectifier arrangement for each LED string and further comprising a switched capacitor in parallel with each LED string and a balancer.

FIG. 5 illustrates a high level schematic diagram of an exemplary embodiment of a synchronous driving architecture for a plurality of LED strings 50, comprising a separate rectifier arrangement for each LED string 50 and further comprising a switched filtering capacitor CF in parallel with each LED string 50 and a balancer 110. The architecture of FIG. 5 is in all respects identical with that of FIG. 4, with the exception that electronically controlled switch Q6 is placed in series with LED strings 50 instead of in series with filtering capacitors CF and filtering capacitors CF are connected to the drain of electronically controlled switch Q3, however the control effect remains the same.

When electronically controlled switches Q1 and Q2 switch at maximum duty, i.e. the duty cycle of each electronically controlled switch Q1, Q2 is about 50%, the voltage waveform and magnetic excitation applied to balancing transformers TB is substantially continuous, and the balancing effect is maintained substantially continuously. However, when electronically controlled switches Q1 and Q2 operate at smaller duty, the magnetic excitation of the balancer transformers TB may not be continuous. Under such circumstance, energy leaking between filter capacitors CF through the balancer windings could occur. To prevent such situation, separate rectifier diodes DA, DB are supplied for each individual balancing transformer, as shown in FIG. 5.

Figure 6:
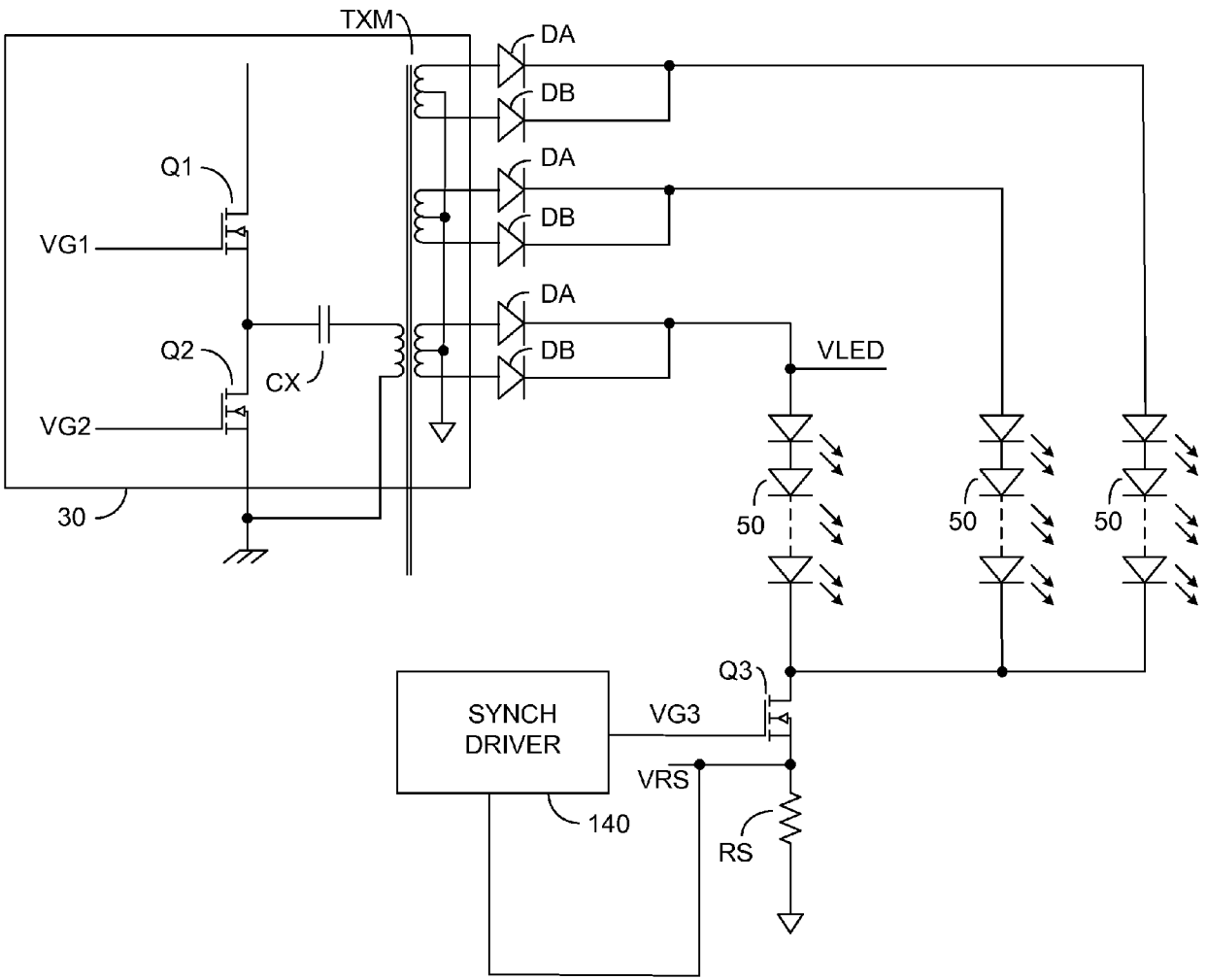
FIG. 6 illustrates a high level schematic diagram of an exemplary embodiment of a synchronous driving architecture for a plurality of LED strings, comprising a multi-winding power transformer arranged to provide an impedance balancer.

FIG. 6 illustrates a high level schematic diagram of an exemplary embodiment of a synchronous driving architecture for a plurality of LED strings 50, comprising a multi-winding power transformer TXM arranged to provide an impedance balancer. A received AC mains power is converted to a DC bus, in one embodiment a DC bus of about 400V, by a PFC stage, and the PFC voltage is converted by isolated switching bridge stage 30, illustrated without limitation as a half bridge driving the primary winding of multi-winding power transformer TXM, as described above in relation to FIGS. 1 and 2. Multi-winding power transformer TXM exhibits a plurality of secondary windings each associated with a particular LED string 50. A first end of each secondary winding of multi-winding power transformer TXM is connected via a respective unidirectional electronic valve DA to the anode end of the associated LED string 50, and a second end of each secondary winding of multi-winding power transformer TXM is connected via a respective unidirectional electronic valve DB to the anode end of the associated LED string 50. The center taps of the secondary windings are commonly connected to a common potential. The cathode ends of the various LED strings 50 are connected to the drain of electronically controlled switch Q3, as described above in relation to FIG. 2, and the source of electronically controlled switch Q3 is connected to the common potential via sense resistor RS. Synchronous driver 140 is arranged to provide signal VG3 to the gate of electronically controlled switch Q3 as described above.

In operation, leakage inductance of multi-winding power transformer TXM is utilized to balance the current between the various LED strings 50. In particular multi-winding power transformer TXM is preferably provided with large equal leakage inductances for each of the secondary windings. When the leakage inductive impedance of the secondary windings is significant enough, e.g. the voltage drop on the leakage inductance during operation is at least 10 times higher than the difference of the operating voltage of the various LED strings 50 at the operating frequency, the current through the various LED strings 50 is kept almost equal with acceptable error. In practice, multi-winding power transformer TXM is normally supplied with large leakage inductance in order to attain soft switching operation of the primary side switching network, and such a feature thus meets the requirement of the above leakage impedance.

Figure 7:
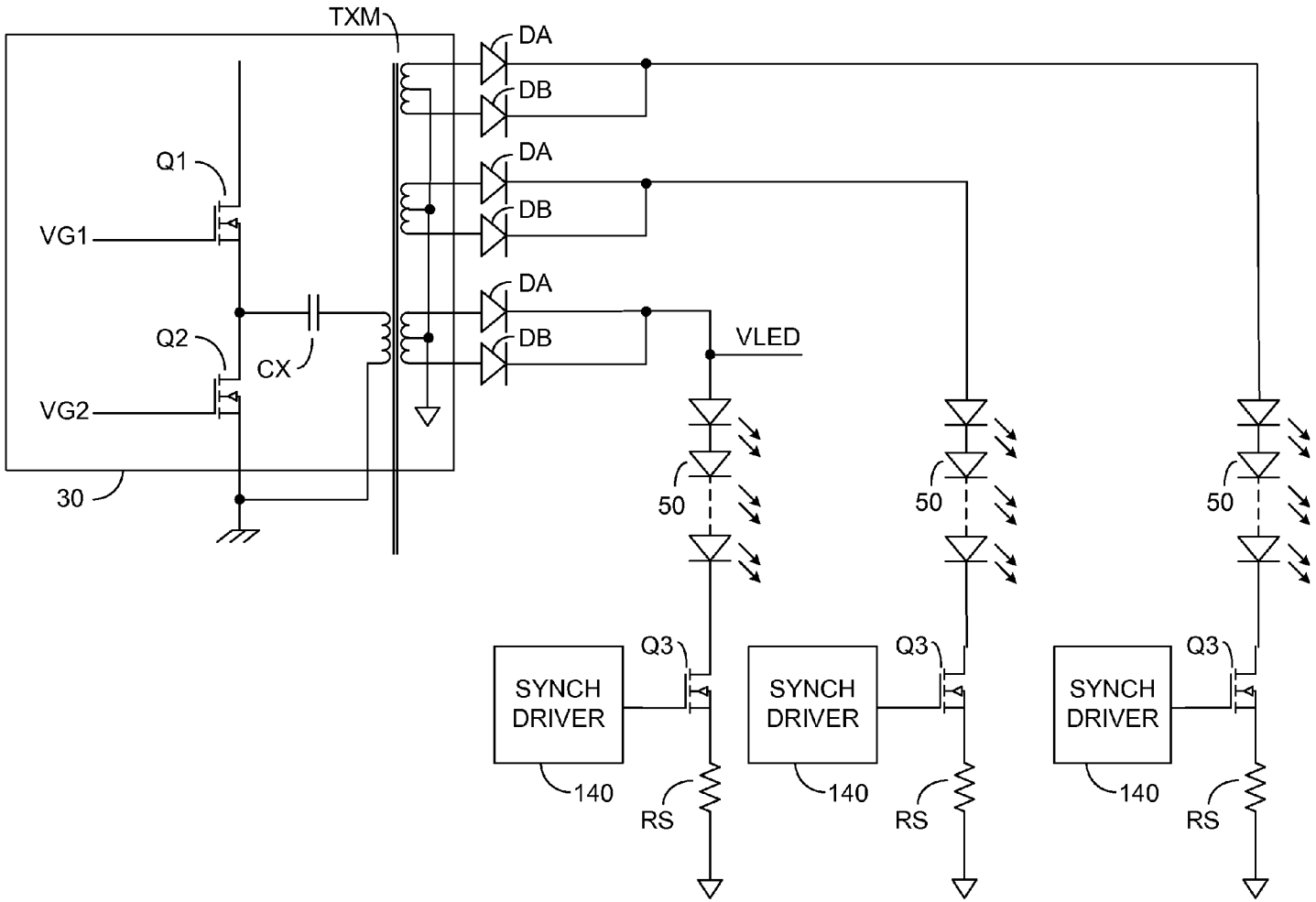
FIG. 7 illustrates a high level schematic diagram of an exemplary embodiment of a synchronous driving architecture for a plurality of LED strings, comprising an electronically controlled switch associated with each LED string and a multi-winding power transformer arranged to provide an impedance balancer.

FIG. 7 illustrates a high level schematic diagram of an exemplary embodiment of a synchronous driving architecture for a plurality of LED strings 50, comprising a plurality of electronically controlled switches Q3 each associated with a particular LED string 50, and each driven with an associated synchronous driver 140, and a multi-winding power transformer TXM arranged to provide an impedance balancer. The architecture of FIG. 7 is in all respects identical with that of FIG. 6, with the exception that an electronically controlled switch Q3 with an associated synchronous driver is supplied for each LED string 50.

The load currents of each secondary winding of multi-winding power transformer TXM do not exhibit a magnetic coupling effect between each other, except for a minor cross regulation due to the above mentioned impedance effect, thus the LED strings 50 attached to each secondary winding can be turned on and off independently without affecting the operation of other LED strings 50. Thus, in the arrangement of FIG. 7 each LED string 50 has a dedicated electronically controlled switch Q3 connected in series with associated synchronous driver 140. With such a configuration, the current and digital dimming on/off of each LED string 50 can be controlled separately. Advantageously, the minor cross regulation effect between the LED strings 50 is easily compensated for by the PWM control of the respective synchronous drivers 140 of the electronically controlled switches Q3.

Figure 8:
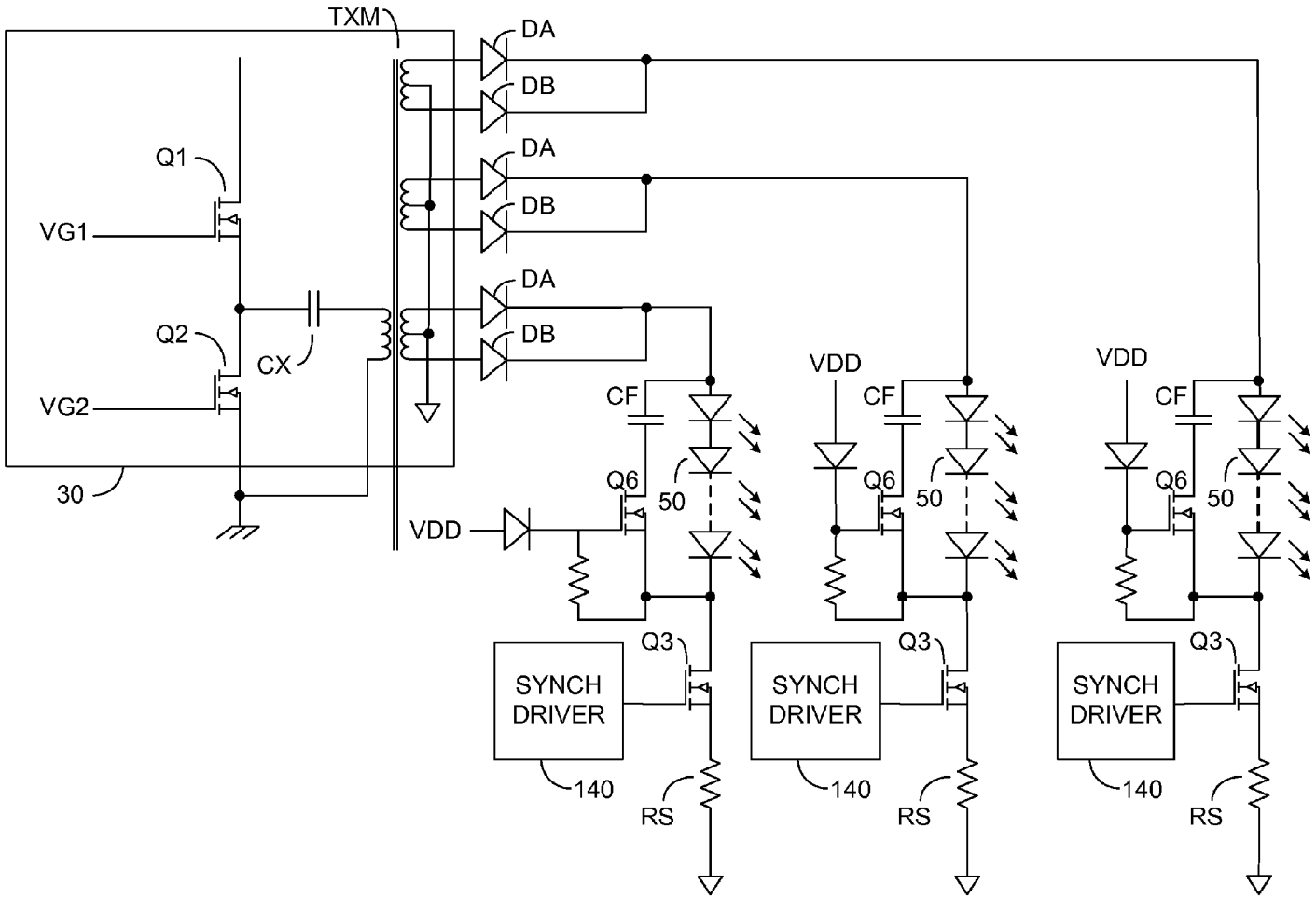
FIG. 8 illustrates a high level schematic diagram of an exemplary embodiment of a synchronous driving architecture for a plurality of LED strings, comprising a switched capacitor in parallel with each LED string, an electronically controlled switch associated with each LED string and a multi-winding power transformer arranged to provide an impedance balancer.

FIG. 8 illustrates a high level schematic diagram of an exemplary embodiment of a synchronous driving architecture for a plurality of LED strings 50, comprising a filtering capacitor CF switchably connected in parallel with each LED string 50, an electronically controlled switch Q3 associated with each LED string 50 and a multi-winding power transformer TXM arranged to provide an impedance balancer.

The architecture of FIG. 8 is in all respects identical with that of FIG. 7, with the exception that a switchably connected filtering capacitor CF is supplied in parallel with each LED string 50, substantially as described above in relation to FIG. 4, with the exception that a separate electronically controlled switch Q6 is provided in series with each filtering capacitor CF. In operation, filtering capacitors CF reduce the ripple content of the current through each LED string 50. When the switching operation of electronically controlled switches Q1 and Q2 is not at maximum duty, i.e. the duty cycle of each electronically controlled switch Q1, Q2 is substantiallyless than 50%, electronically controlled switches Q6 in series with the respective filter capacitors CF, or alternatively with the LED strings as described above in relation to FIG. 5, are controlled to cut off the leaking path when the respective regulation electronically controlled switch Q3 is off during a digital dimming off period.

Figure 9:
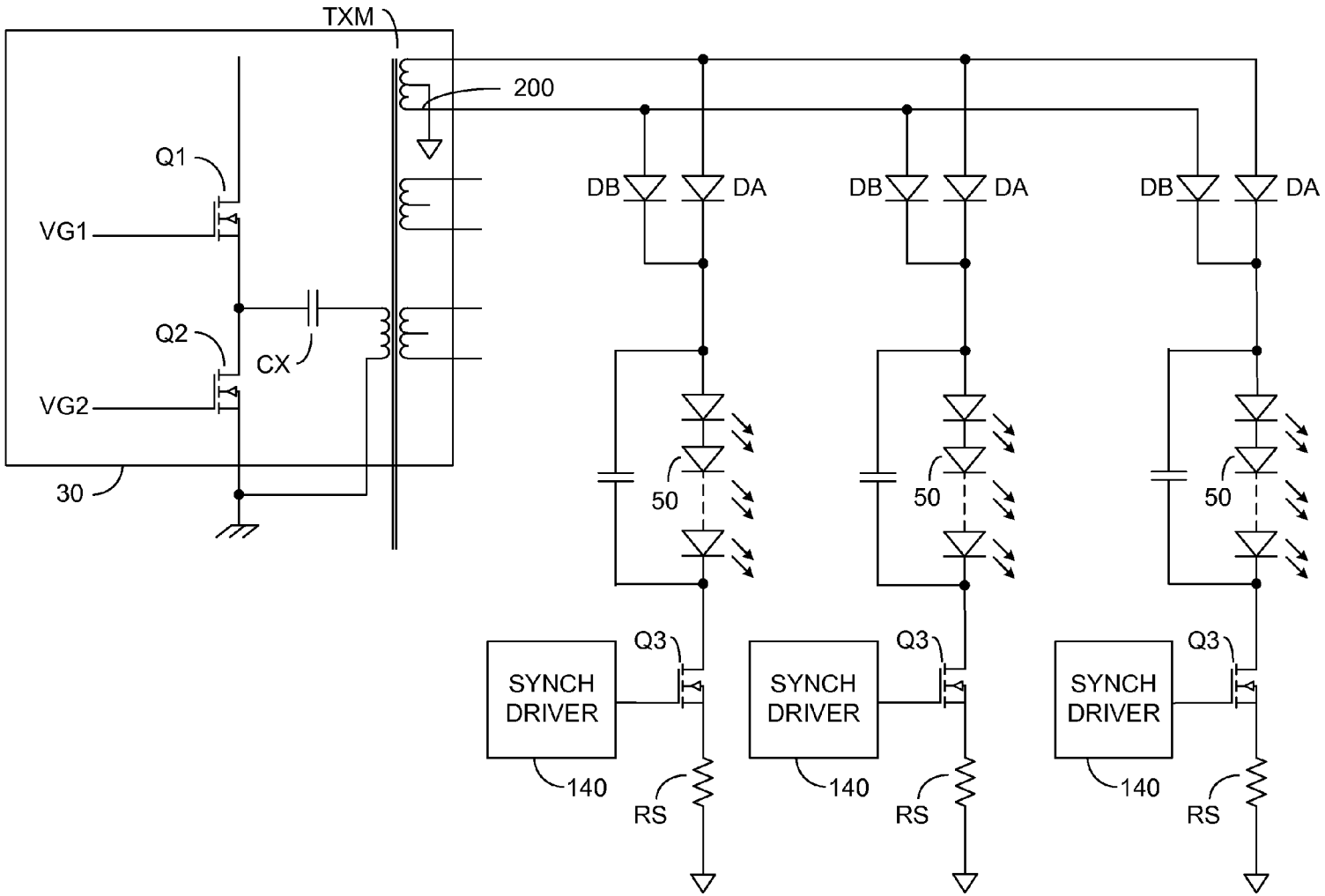
FIG. 9 illustrates a high level schematic diagram of an exemplary embodiment of a synchronous driving architecture for a plurality of LED strings, comprising a power transformer exhibiting a plurality of loads, an electronically controlled switch associated with each LED string with a parallel capacitor provided for each LED string.

FIG. 9 illustrates a high level schematic diagram of an exemplary embodiment of a synchronous driving architecture for a plurality of LED strings 50, comprising: a multi-winding power transformer TXM exhibiting a plurality of secondary windings; a plurality of LED strings 50 associated with a particular one of the plurality of the secondary windings, denoted secondary winding 200; a plurality of filtering capacitors CF, each connected in parallel with a respective LED string 50; and a plurality of electronically controlled switches Q3, each connected in series with a respective LED string 50 and the associated filtering capacitor CF. A received AC mains power is converted to a DC bus, in one embodiment to a DC bus of 400V, by a PFC stage, and the PFC voltage is converted by isolated switching bridge stage 30, illustrated without limitation as a half bridge, driving the primary winding of multi-winding power transformer TXM, as described above in relation to FIGS. 1 and 2. Secondary winding 200 of multi-winding power transformer TXM is utilized to drive LED strings 50, with the other secondary windings of power transformer TXM utilized for other loads (not shown). A first end of secondary winding 200 is connected to the anode end of each LED string 50 by a respective unidirectional electronic valve DA and a second end of second winding 200 is connected to the anode end of each LED string 50 by a respective unidirectional electronic valve DB. The center tap of winding 200 is connected to a common potential. Each of the LED strings 50 is connected to the drain of a respective electronically controlled switch Q3, the gate of each electronically controlled switch Q3 is controlled by an associated respective synchronous driver 140, and the source of each electronically controlled switch Q3 is connected via a respective sense resistor RS to the common potential.

The advantage of the synchronous regulation architecture described herein is readily apparent, particularly where the LED power supply shares the same power converter with other output voltages. The switching action of primary side electronically controlled switches Q1 and Q2 is typically controlled by one of the DC outputs instead of the LED current regulation loop. The prior art, as described above in relation to FIG. 1, teaches the use of a DC to DC conversion stage, such as boost converter 40, to precisely control the DC supply voltage of LED strings 50 so as to minimize power dissipation of the linear regulation stage. Contrastingly, the architecture of FIG. 9 provides regulation of the current through the various LED strings 50 by pulse width modulation of the respective electronically controlled switches Q3 synchronously with the switching action of electronically controlled switches Q1 and Q2. The switching regulation operation of electronically controlled switches Q3, responsive to the respective associated synchronous drivers 140, tolerates wide supply voltage variation with very low power dissipation, and thus the DC to DC conversion stage can be completely removed, saving both the system cost and power losses. Furthermore, because the operation of the various electronically controlled switches Q3 can be controlled independently, such circuit configuration can be used for dimming control in backlight systems where the on and off time of each LED string 50 may need to be controlled independently according to video display content. Filtering capacitor CF is operative to filter the current through the respective LED string 50, thus reducing ripple. The leakage inductance of secondary winding 200 of multi-winding power transformer TXM, which as described above is normally significant, further acts to filter the LED current in cooperation with the respective filtering capacitors CF, forming an LC filter further reducing ripple.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

I claim:

1. A light emitting diode (LED) based luminaire driving arrangement comprising:

a switched power conversion stage having a power transformer with a primary and at least one secondary winding, the switched power conversion stage arranged to produce a predetermined voltage across the secondary winding;

a plurality of LED based luminaries arranged to receive power in parallel from said at least one secondary winding of said switched power conversion stage;

a balancer constituted of a plurality of balancing transformers, each of said plurality of balancing transformers exhibiting a first winding and a second winding magnetically coupled to said first winding, said first winding of each of said balancing transformers connected in series with a particular one of the plurality of LED based luminaries and said second windings of said plurality of balancing transformers connected in a closed serial loop;

an electronically controlled switch in series with said plurality of parallel LED based luminaries and arranged to alternatively pass current through said plurality of parallel LED based luminaries when closed and prevent the flow of current through said plurality of parallel LED based luminaries when opened; and a synchronous driver in communication with said electronically controlled switch, said synchronous driver arranged to close said electronically controlled switch only when said switched power conversion stage is actively supplying power via said at least one secondary winding and further comprising a plurality of capacitors, each of said plurality of capacitors switch-ably connected in parallel with a particular one of the plurality of parallel LED based luminaries LEDs.

2. The LED based luminaire driving arrangement according to claim 1, wherein each of said plurality of LED based luminaries is constituted of a string of serially connected LEDs.

3. The LED based luminaire driving arrangement according to claim 1, further comprising a plurality of capacitors, each of said plurality of capacitors connected in parallel with a particular one of the plurality of parallel LED based luminaries.

4. The LED based luminaire driving arrangement according to claim 1, wherein said power transformer of said switched power conversion stage comprises a plurality of secondary windings, each of said plurality of LED based luminaries arranged to receive power from a common one of said secondary windings thereby receiving power from said switched power conversion stage, said predetermined voltage controlled responsive to the voltage developed across a non-common one of said secondary windings.

5. The LED based luminaire driving arrangement according to claim 1, wherein said synchronous driver is leading edge modulated.

6. A method of driving a plurality of light emitting diode (LED) based luminaries, the method comprising:

providing power with a predetermined voltage across at least one secondary winding of a switched power conversion stage;

switchably driving said plurality of LED based luminaries synchronously with said provided power from said at least one secondary winding only when said switched power conversion stage is actively supplying power via said at least one secondary winding, wherein an end of each of said plurality of LED based luminaries is connected to a common node; and balancing the current flow through each of said parallel connected LED based luminaries by providing a balancer constituted of a plurality of balancing transformers, each of said plurality of balancing transformers exhibiting a first winding and a second winding magnetically coupled to said first winding, said first winding of each of said balancing transformers connected in series with a particular one of the plurality of LED based luminaries and said second windings of said plurality of balancing transformers connected in a closed serial loop and further comprising filtering the voltage drop across each of the plurality of LEDs by providing a plurality of capacitors, each of said plurality of capacitors switchably connected in parallel with a particular one of the plurality of LEDs.

7. The method of claim 6, wherein each of said plurality of LED based luminaries is constituted of a string of serially connected LEDs.

8. The method according to claim 6, further comprising filtering the voltage drop across each of the plurality of LED based luminaries by providing a plurality of capacitors, each of said plurality of capacitors connected in parallel with a particular one of the provided plurality of LED based luminaries.

9. The method according to claim 6, wherein the leading edge of said switchably driving is modulated.

* * * * *